US008770440B2

(12) United States Patent
Lin

(10) Patent No.: US 8,770,440 B2
(45) Date of Patent: Jul. 8, 2014

(54) COUNTERTOP AUTOMATIC FOAM SOAP DISPENSER

(75) Inventor: Moses-B. Lin, Taipei (TW)

(73) Assignee: Ableman International Company Ltd., Taipei (TW)

( * ) Notice: Subject to any disclaimer, the term of this patent is extended or adjusted under 35 U.S.C. 154(b) by 8 days.

(21) Appl. No.: 13/561,151

(22) Filed: Jul. 30, 2012

(65) Prior Publication Data

US 2014/0027468 A1 Jan. 30, 2014

(51) Int. Cl.
*B67D 1/00* (2006.01)

(52) U.S. Cl.
USPC ..... 222/63; 222/180; 222/190; 222/333

(58) Field of Classification Search
USPC ..... 222/52, 63, 185.1, 190, 333, 173, 180, 222/382
See application file for complete search history.

(56) References Cited

U.S. PATENT DOCUMENTS 6,929,150 B2 * 8/2005 Muderlak et al. ..... 222/1
7,647,653 B1 * 1/2010 Catania ..... 4/628
7,766,194 B2 * 8/2010 Boll et al. ..... 222/333
2003/0075565 A1 * 4/2003 Gerenraich et al. ..... 222/207
2008/0121660 A1 * 5/2008 Ophardt ..... 222/190
2009/0166381 A1 * 7/2009 Phelps et al. ..... 222/180
2010/0051640 A1 * 3/2010 Chen ..... 222/52
2010/0314413 A1 * 12/2010 Jones et al. ..... 222/173

* cited by examiner

*Primary Examiner* — Paul R Durand
*Assistant Examiner* — Andrew P Bainbridge
(74) *Attorney, Agent, or Firm* — Rosenberg, Klein & Lee

(57) ABSTRACT

A countertop automatic foam soap dispenser includes an automatic foam soap dispenser body, a soap liquid container, a circular connecting tube and a battery compartment. The soap liquid container is filled with an appropriate quantity of liquid soap. The battery compartment supplies electric power to the automatic foam soap dispenser body. The automatic foam soap dispenser body is passed through the circular connecting tube by a soap transmission tube and installed to the bottom inside the soap liquid container. The automatic foam soap dispenser body includes a foam soap valve, a control circuit board, a sensor, a motor controlled by the control circuit board, and a transmission gear set. When a user's hand approaches a sensor of the automatic foam soap dispenser body, the motor drives a cam of the transmission gear set to rotate and compress a foam soap valve to supply the appropriate quantity of foam soap.

5 Claims, 8 Drawing Sheets

COUNTERTOP AUTOMATIC FOAM SOAP DISPENSER

BACKGROUND OF THE INVENTION

1. Field of the Invention

The present invention relates to a countertop automatic foam soap dispenser, in particular to the automatic foam soap dispenser installed on a countertop next to a faucet of a sink, and having a soap supplying outlet formed on the automatic foam soap dispenser and aligned towards the sink. The invention provides an automatic sensing foam soap dispenser.

2. Description of the Prior Art

As living standards improve, long-existing manual pressing soap dispensers are gradually replaced by automatic sensing soap dispensers. Conventional automatic soap dispensers are generally installed and fixed on walls, and foam soap is usually remained at a soap supplying outlet of the conventional automatic soap dispenser, and the soap liquid will drop directly from the soap supplying outlet after a certain time of using, and thus staining the countertop or the floor.

In addition, the conventional wall-hanging type automatic soap dispenser is installed and fixed on walls, so that the carrying load cannot be over-weight, and the volume of the soap liquid stored in the dispenser body will be limited, and must be refilled frequently. If the soap liquid is leaked from the dispenser body, the component and the control circuit of the dispenser may be damaged easily, thus incurring higher repair and maintenance costs.

In view of the drawbacks of the conventional soap dispenser, the inventor of the present invention based on years of experience in the related industry to conduct extensive researches and experiments, and finally developed a countertop automatic foam soap dispenser in accordance with the present invention to overcome the drawbacks of the prior art.

SUMMARY OF THE INVENTION

Therefore, Therefore, it is a primary objective of the present invention to overcome the drawbacks of the prior art by providing a countertop automatic foam soap dispenser, not only providing a convenient use, but also improving the service life and practical effect of the automatic foam soap dispenser.

To achieve the foregoing objectives, the present invention provides a countertop automatic foam soap dispenser, comprising: an automatic foam soap dispenser body, a soap liquid container, a circular connecting tube and a battery compartment. The soap liquid container is filled with an appropriate quantity of liquid soap and has a circular connecting tube installed at the top of the soap liquid container, and an external screw thread formed at an upper-half external periphery of the circular connecting tube, a connecting socket disposed on a side of the circular connecting tube. The battery compartment is electrically coupled to the connecting socket through a connecting plug at an end of a power cord, and the connecting socket is coupled to a power cord, and the power cord is electrically coupled to the automatic foam soap dispenser body, and a nut is installed to the circular connecting tube at the top of the soap liquid container, and then the circular connecting tube is penetrated through a countertop of a sink and screwed to the bottom of the automatic foam soap dispenser body, and the nut is provided for fixing the soap liquid container and the automatic foam soap dispenser body to the countertop of the sink.

The automatic foam soap dispenser body has a lid that can be lifted open and a casing formed by engaging a left casing and a right casing, and the casing includes a pressing foam soap valve for supplying soap, a control circuit board electrically coupled to the battery compartment, a motor and a transmission gear set controlled by the control circuit board, and a sensor for sensing an approaching object to feed back a signal to the control circuit board to start the motor to rotate, drive and press the foam soap valve. The invention is characterized in that a soap transmission tube is coupled to an end of the foam soap valve, and the soap transmission tube is passed through the bottom inside the soap liquid container. When a user's hand approaches the sensor, the motor drives the cam installed on the transmission gear set to rotate, so as to drive the press plate of slide member to compress the foam soap valve and supply an appropriate quantity of foam soap.

The soap dispenser of the present invention is installed on a countertop next to a faucet of a sink, and the soap supplying outlet of the automatic foam soap dispenser is aligned towards the interior of the sink, such that even if soap liquid drops from the soap dispenser, the soap will drop into the sink directly to maintain a clean and hygienic effect.

In addition, the present invention separately installs the automatic foam soap dispenser body and the soap liquid container at the upper and lower position of the countertop of the sink, and the volume of soap contained in the soap liquid container can be increased, and the soap can be refilled as needed. The circuit components and foam soap valve installed inside the automatic foam soap dispenser body have a long service life.

DETAILED DESCRIPTION OF THE PREFERRED EMBODIMENTS

To make it easier for our examiner to understand the technical characteristics, effects and advantages of the present invention, we use preferred embodiments with related drawings for the detailed description of the present invention as follows.

Figure 1:
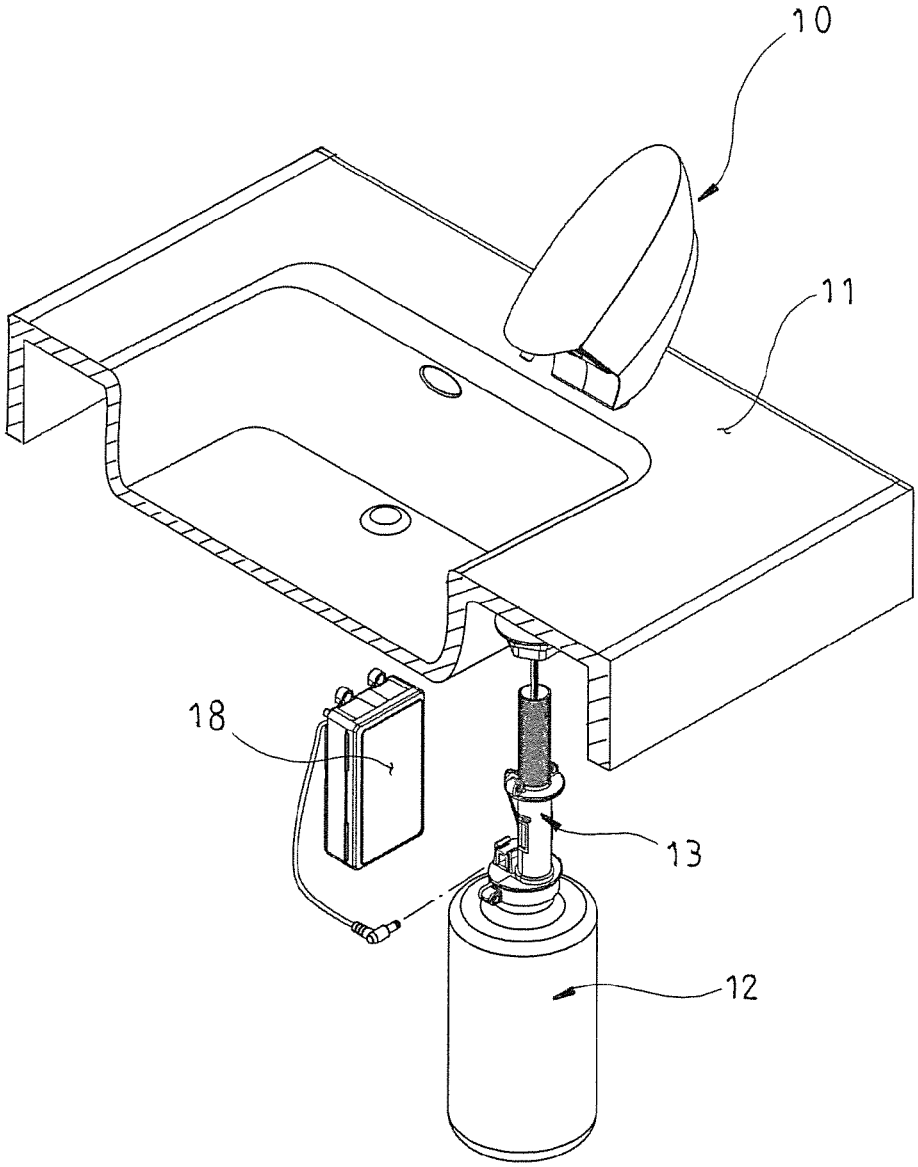
FIG. 1 is a perspective view of an automatic foam soap dispenser installed to a sink in accordance with the present invention.
Figure 2:
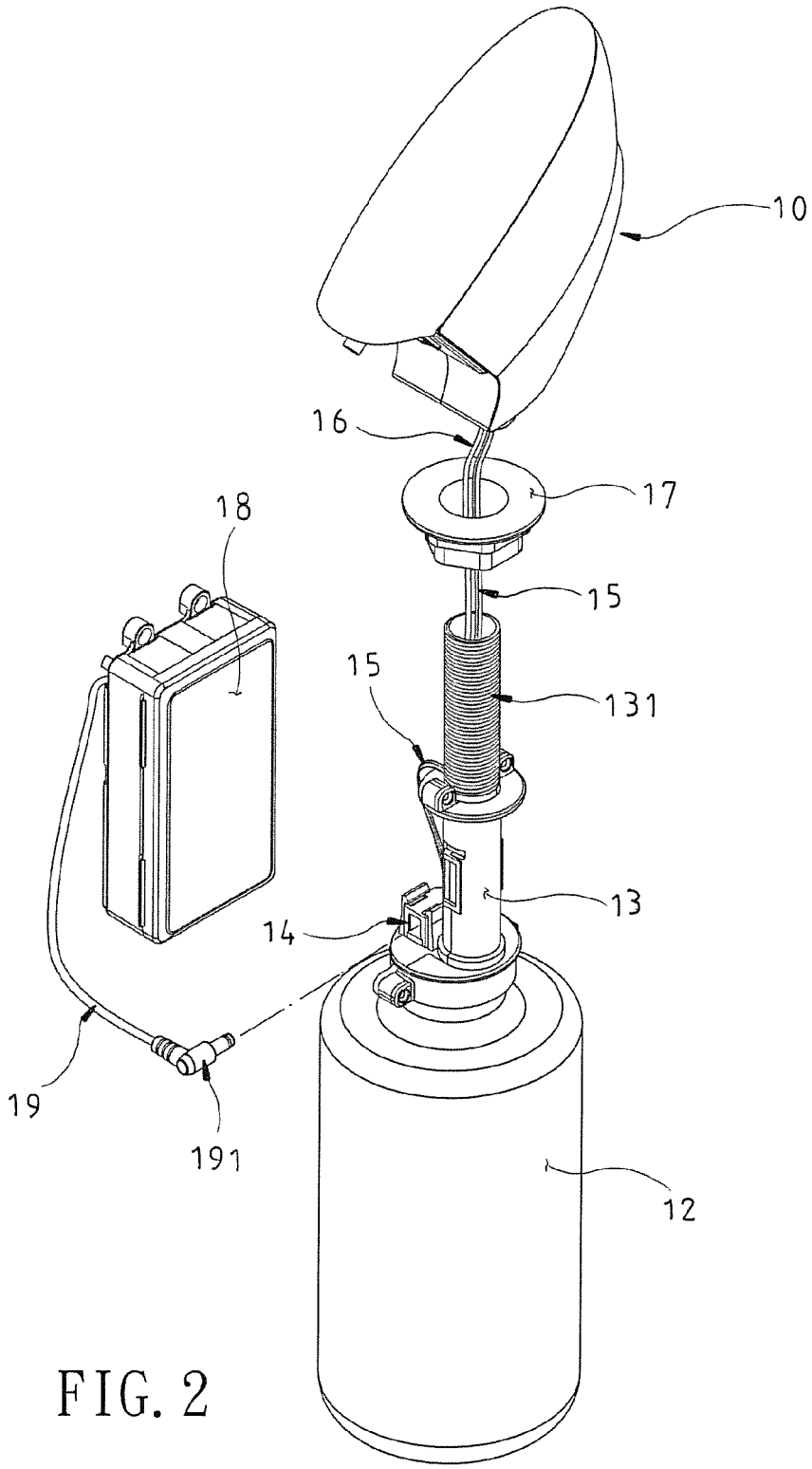
FIG. 2 is an exploded view of an automatic foam soap dispenser of the present invention.

In FIGS. 1 and 2, a countertop automatic foam soap dispenser of the present invention comprises: an automatic foam soap dispenser body (10), a soap liquid container (12), a circular connecting tube (13) and a battery compartment (18). The soap liquid container (12) is filled with an appropriate quantity of liquid soap and has the circular connecting tube (13) installed at the top of the soap liquid container (12), an external screw thread (131) formed at an upper-half external periphery of the circular connecting tube (13), a connecting socket (14) disposed at the top of the soap liquid container (12) and proximate to a side of the circular connecting tube (13) and electrically coupled to a power cord (15), and the power cord (15) is electrically coupled to the automatic foam soap dispenser body (10). The battery compartment (18) provides a direct-current power, and a connecting plug (191) is electrically coupled to the connecting socket (14) through an end of the power cord (19), and a nut (17) is passed through the circular connecting tube (13) at the top of the soap liquid container (12) and then the circular connecting tube (13) is penetrated through a countertop (11) of a sink and screwed to the bottom of the automatic foam soap dispenser body (10), and the nut (17) is provided for combining and fixing the soap liquid container (12) and the automatic foam soap dispenser body (10) to the countertop (11) of the sink.

Another assembled device of the present invention changes the battery compartment for supplying DC power to an AC adapter for supplying power, and the AC adapter is electrically coupled to a connecting socket through an end of a power cord, and the connecting socket is coupled to a power cord, and the power cord is coupled to the countertop automatic foam soap dispenser.

Figure 3:
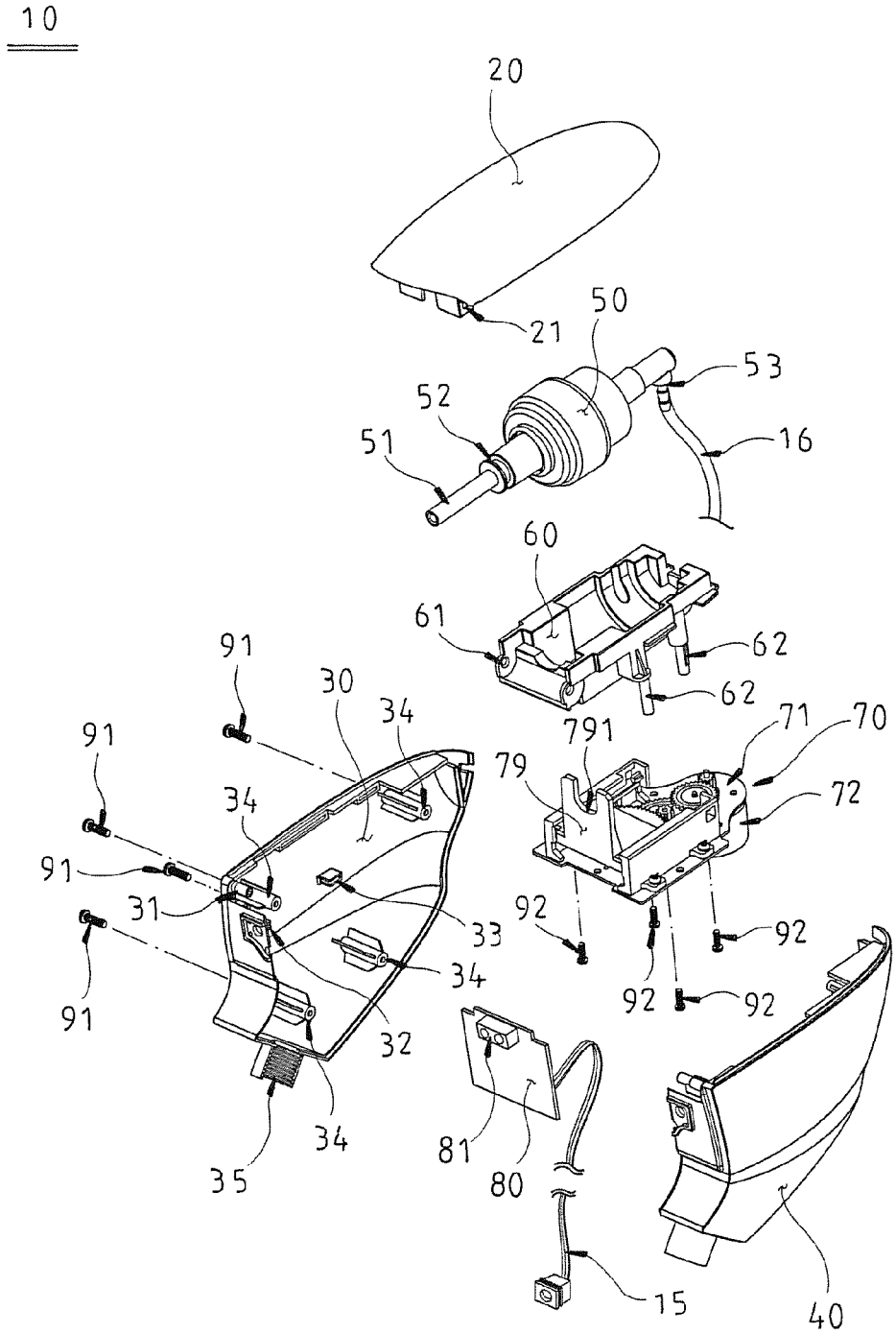
FIG. 3 is an exploded view of an automatic foam soap dispenser body (10) of the present invention.

With reference to FIG. 3, the automatic foam soap dispenser body (10) comprises a lid (20), a left casing (30), a right casing (40), a foam soap valve (50), a support base (60), a press device (70) and a control circuit board (80).

The lid (20) is substantially an arc-shell cover having a shaft hole (21) formed on both sides of a lower edge of the front of the lid separately.

The left casing (30) has a convex shaft (31) convexly disposed at an inner side of the upper edge of the front of the left casing (30), two latch fasteners (32, 33) and a plurality of convex screw shafts (34) convexly disposed inside the left casing (30), and a semicircular tubular internal screw thread (35) formed at the bottom of the left casing (30).

The right casing (40) is installed at a position corresponding to the left casing (30).

The foam soap valve (50) includes a long circular tubular nozzle (51) protruded from a front end of the foam soap valve (50), a circular snap slot (52) formed at a rear section of the nozzle (51), a connector (53) installed at a rear end of the foam soap valve (50) and downwardly extended and sheathed on a soap transmission tube (16). With air pressure, the foam soap valve (50) drives soap liquid and air to pass through a foaming component inside the foam soap valve (50) to form foam soap from the liquid soap. Since the foaming technology is a prior art, it will not be described in detailed here.

The support base (60) is substantially in form of a semicircular cylindrical frame having a shaft hole (61) formed on both sides of the front of the support base (60) separately, and a plurality of convex screw shafts (62) disposed at the bottom of the support base (60).

Figure 4:
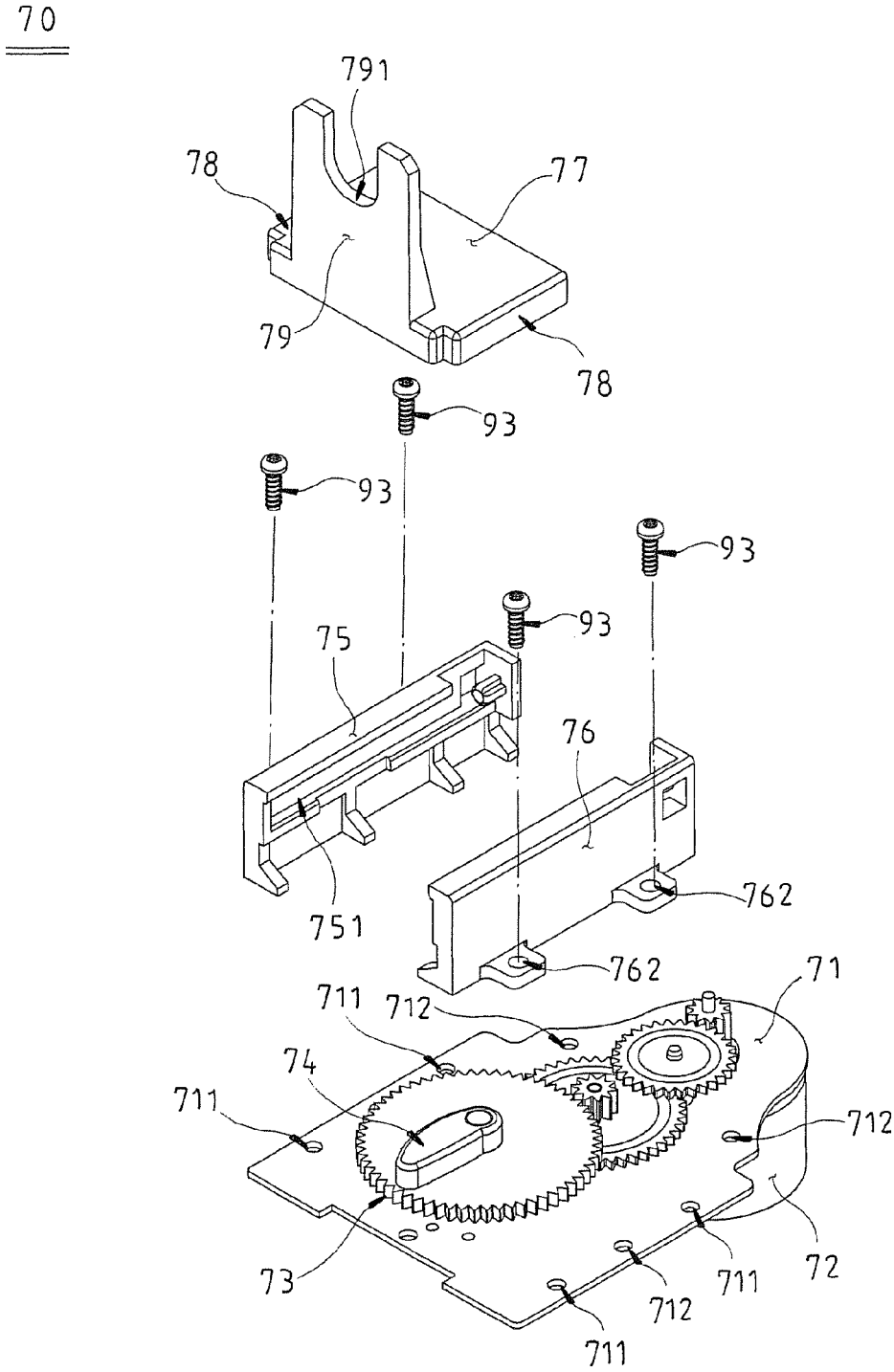
FIG. 4 is an exploded view of a press device (70) of the present invention.

With reference to FIG. 4, the press device (70) comprises a fixed plate (71), a motor (72), a transmission gear set (73), two fixing members (75, 76) and a slide member (77).

The fixed plate (71) has a plurality of screw holes (711, 712), and the motor (72) is installed at a lower edge of the rear of the fixed plate (71), and the transmission gear set (73) includes a plurality of large and small gears engaged with one another and installed and axially coupled to an upper edge of the fixed plate (71), and a cam (74) is axially coupled to the transmission gear set (73).

The fixing member (75) has a concave long slot (751) formed at the middle of an inner side of the fixing member (75), and two screw holes (not shown in the figure) formed on an outer side of the fixing member (75).

The fixing member (76) has a concave long slot (not shown in the figure) formed at the middle of an inner side of the fixing member (76) and two screw holes (762) formed on an outer side of the fixing member (76).

Figure 7:
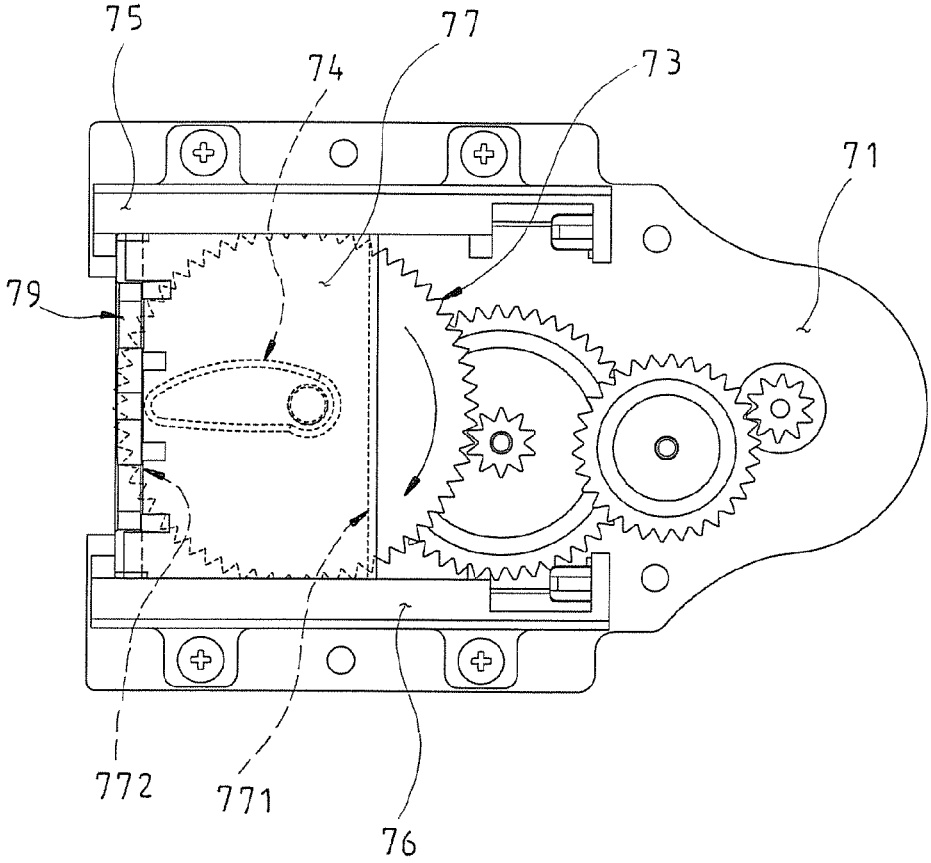
FIGS. 7 and 8 are planar schematic views showing the operation of pressing an automatic foam soap dispenser to supply soap in accordance with the present invention.

The slide member (77) includes a slender protruding block (78) convexly extended from both sides of the slide member (77), a press plate (79) convexly and vertically extended upward from a front end of the slide member (77), a semicircular arc groove hole (791) concavely formed at the middle of the press plate (79). In FIG. 7, the slide member (77) is substantially in form of a frame cover having an upper baffle (771) installed at the bottom of a side of the slide member (77) and a lower baffle (772) installed on the other side of the slide member (77). The slide member (77) is contained into a long groove of the two fixing members (75, 76) through the protruding blocks (78) on both sides, and a plurality of screws (93) are passed through the screw holes formed on external sides of the two fixing members (75, 76) and screwed to the screw holes (711) of the fixed plate (71), such that the slide member (77) can be covered onto the cam (74) of the transmission gear set (73) to constitute a whole press device (70).

The support base (60) is fixed to the convex screw shaft (62) of the support base (60) by passing a plurality of screws (92) through the screw holes (712) of the fixed plate (71), so that the foam soap valve (50) can be installed inside the support base (60), and the snap slot (52) formed at a front section of the foam soap valve (50) is latched into the semicircular arc groove hole (791) of the press plate (79) at the front end of the slide member (77). The fixed plate (71) of the press device (70) is latched with the two latch fasteners (32, 33) convexly disposed in the left casing (30). The shaft hole (61) formed on a side of the front of the support base (60) is sheathed on the convex shaft (31) installed on an inner side of the upper edge of the left casing (30). The shaft hole (21) formed at the lower edge of the front end of the lid (20) is sheathed on the convex shaft (31) of the left casing (30), and a sensor (81) is installed on an outer side of the top of the control circuit board (80) to latch the control circuit board (80) into the front edge of the left casing (30) to engage the left casing (30) and the right casing (40), and a plurality of screws (91) are passed through the convex screw shafts (34) of the left casing (30) and screwed to the right casing (40) to assemble a whole automatic foam soap dispenser body (10).

Figure 5:
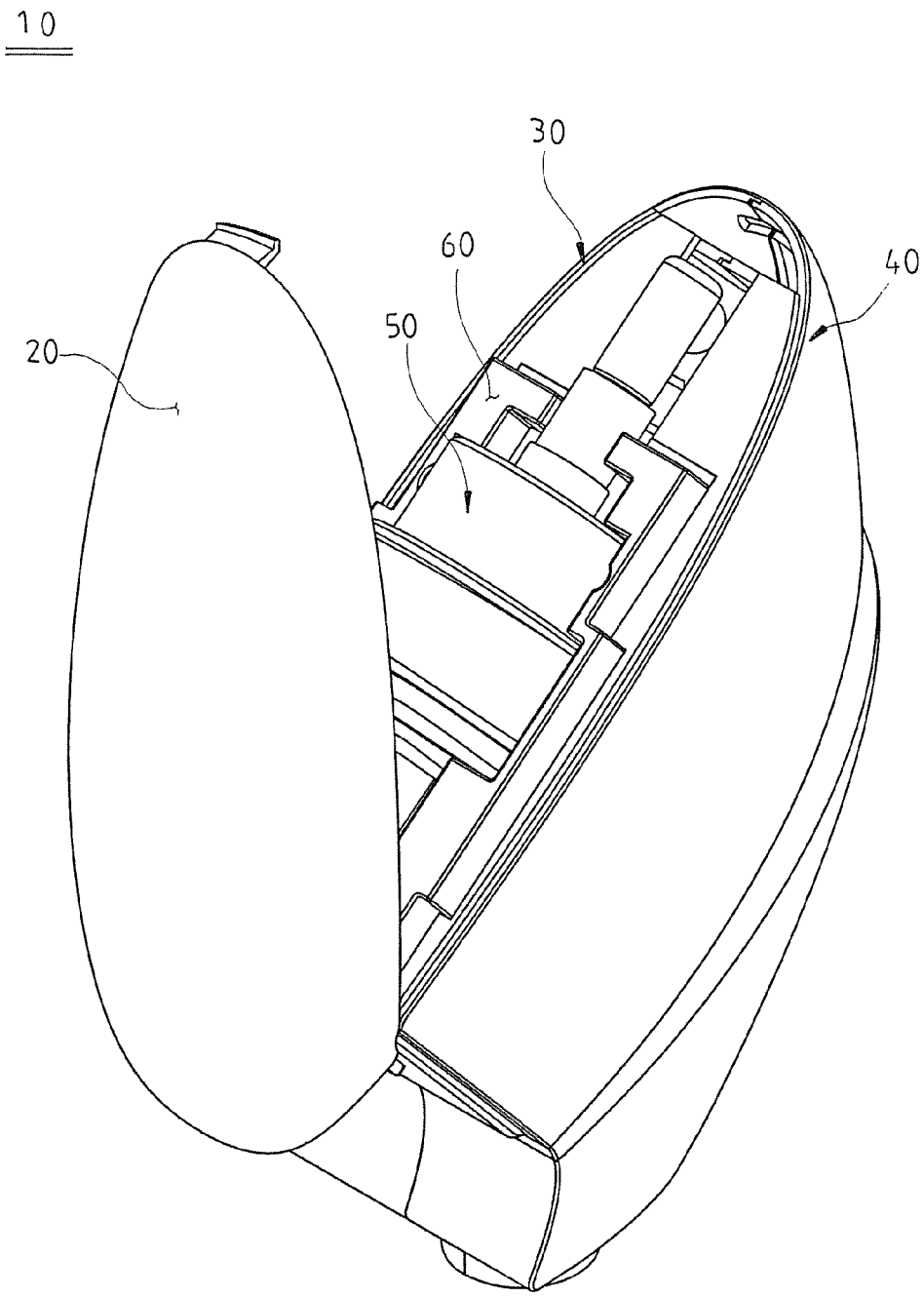
FIG. 5 is a schematic view of a lid (20) of an automatic foam soap dispenser body (10) of the present invention being lifted open.

In FIG. 5, the lid (20) of the automatic foam soap dispenser body (10) of the present invention is axially coupled to the left casing (30) and the upper portion of the front of the right casing (40), and the lid (20) can be lifted open, so that the foam soap valve (50) can be maintained or replaced conveniently.

Figure 6:
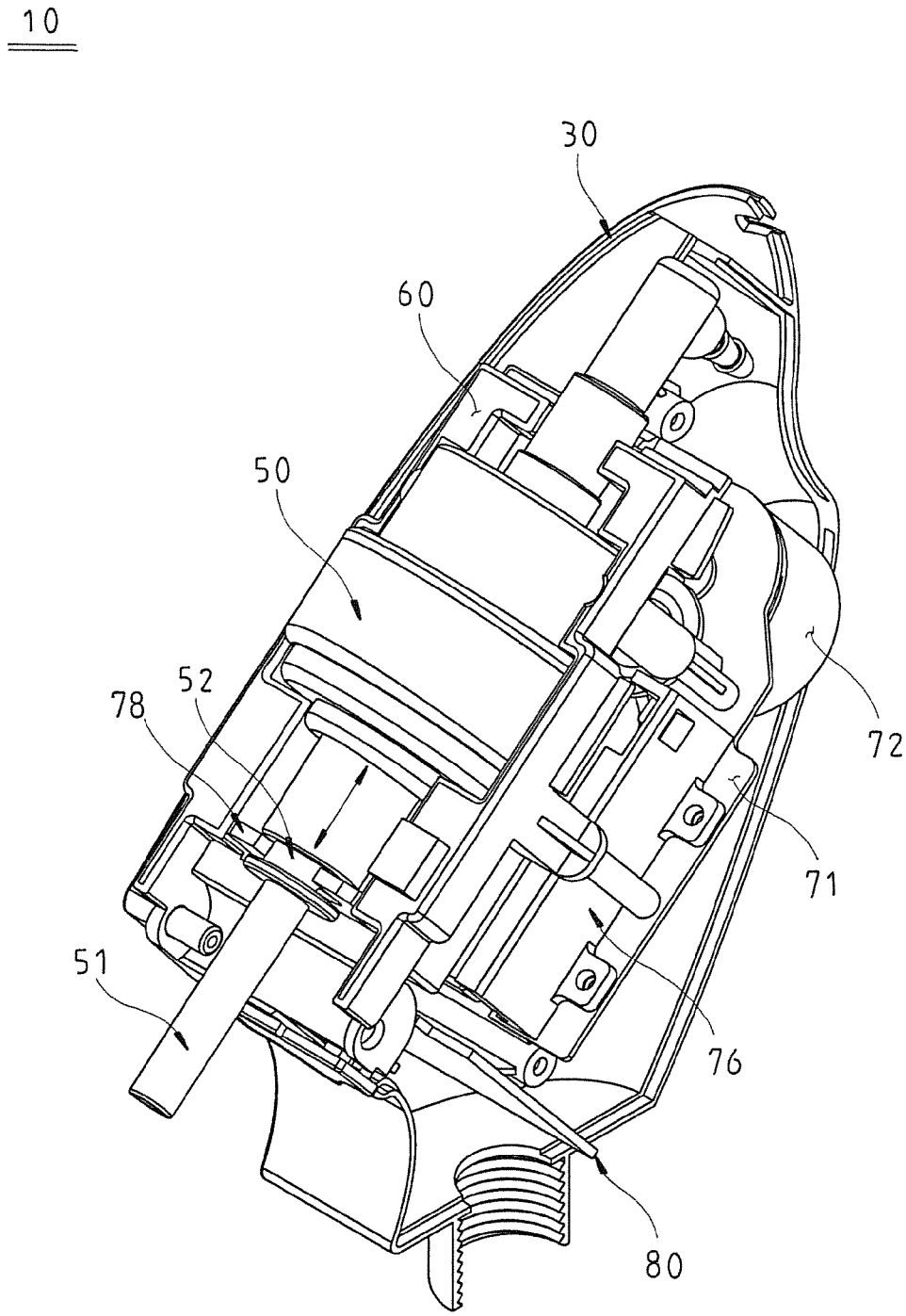
FIG. 6 is a partial perspective view of an automatic foam soap dispenser body (10) of the present invention.
Figure 8:
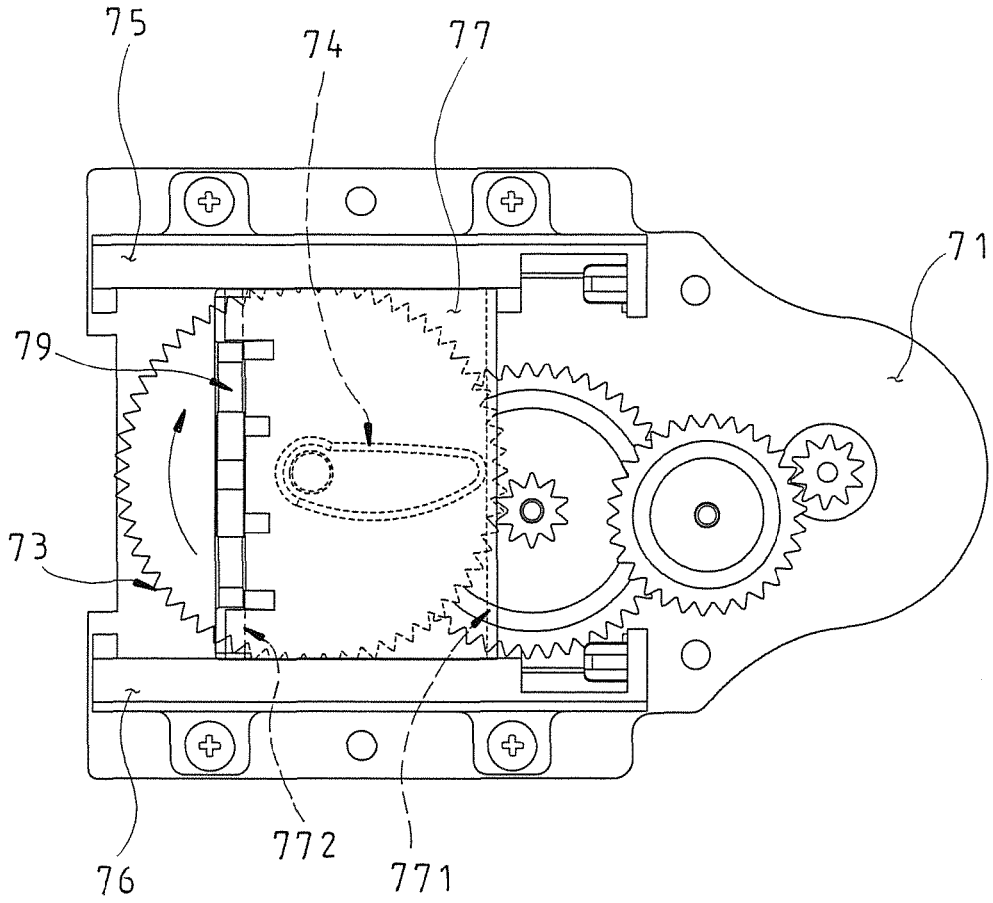

With reference to FIGS. 6 to 8 for the way of supplying foam soap in accordance with the present invention foam soap, when a user's hand approaches a sensor (81) installed on an outer side of the top of the control circuit board (80), a motor (72) is driven to rotate the transmission gear set (73) clockwise and drive the cam (74) to synchronously rotate clockwise. When an edge of the cam (74) pushes the upper baffle (771) of the slide member (77) as shown in FIG. 8, the press plate (79) of the slide member (77) compresses the foam soap valve (50) to supply an appropriate quantity of foam soap from the nozzle (51). When the cam (74) continues rotating clockwise, the edge of the cam (74) pushes the lower baffle (772) of the slide member (77) as shown in FIG. 7 to return the press plate (79) of the slide member (77) to its original position, so as to complete the process of supplying soap.

While the invention has been described by means of specific embodiments, numerous modifications and variations could be made thereto by those skilled in the art without departing from the scope and spirit of the invention set forth in the claims.

What is claimed is:

1. A countertop automatic foam soap dispenser, comprising: an automatic foam soap dispenser body, a soap liquid container and a battery compartment, characterized in that:

the soap liquid container is filled with an appropriate quantity of liquid soap, and has a circular connecting tube installed at the top of the soap liquid container, and a connecting socket disposed at the top of the soap liquid container and proximate to a side of the circular connecting tube;

the automatic foam soap dispenser body is installed and passed through the circular connecting tube by a soap transmission tube and extended to the bottom inside the soap liquid container, such that the automatic foam soap dispenser is driven to supply an appropriate quantity of foam soap when a user's hand approaches the automatic foam soap dispenser body;

the battery compartment provides a direct-current power, and a connecting plug installed at an end of the power cord is electrically coupled to a connecting socket, and the connecting socket is electrically coupled to a power cable, and the power cable is electrically coupled to the automatic foam soap dispenser;

the liquid soap container is installed under the countertop of the sink, and the circular connecting tube at the top of the liquid soap container is penetrated through the countertop of the sink and coupled to the bottom of the automatic foam soap dispenser body for combining and fixing the liquid soap container and the automatic foam soap dispenser body to the countertop of the sink to assemble a whole countertop automatic foam soap dispenser structure;

wherein the automatic foam soap dispenser body comprises a lid that can be lifted and opened upward, and a casing formed by engaging a left casing and a right casing, and the casing contains a pressing foam soap valve for supplying soap, a control circuit board electrically coupled to the battery compartment for an operation, a press device controlled by the control circuit board, and a sensor for sensing an approaching object and feeding back a signal to the control circuit board to start the press device to press the foam soap valve, and an end of the foam soap valve is coupled to the soap transmission tube, and the soap transmission tube is passed through the bottom of the liquid container, such that the press device is driven to press the foam soap valve to supply an appropriate quantity of foam liquid when the user's hand approaches the sensor; and wherein the press device comprises a fixed plate, a motor, a transmission gear set, two fixing members and a slide member, characterized in that:

the fixed plate has a plurality of screw holes;

the motor is installed at a lower edge of the rear of the fixed plate;

the transmission gear set includes a plurality of large and small gears engaged with one another and installed and axially coupled to an upper edge of the fixed plate, and a cam axially coupled to the transmission gear set, and the motor is rotated to synchronously rotate the cam of the transmission gear set;

the two fixing members have a concave long slot formed at the middle of an inner side of the fixing members, and two screw holes formed on an outer side of the fixing members;

the slide member includes a slender protruding block convexly extended from both sides of the slide member, a press plate convexly and vertically extended upward from a front end of the slide member, and a semicircular arc groove hole concavely formed at the middle of the press plate, and a snap slot of a nozzle at a front end of the foam soap valve is snapped into the semicircular arc groove, and the slide member is substantially a frame cover having an upper baffle disposed at the bottom of a side of the frame cover, and a lower baffle disposed on the other side of the frame cover; and the slide member has a protruding block disposed separately on both sides of the slide member and installed in a long groove of each of the two fixing members, a plurality of screws installed into screw holes on external sides of the two fixing members respectively and screwed into screw holes of the fixed plate to cover the slide member onto a cam of the transmission gear set, so as to assemble a whole press device structure, and the motor is rotated to synchronously rotate the cam of the transmission gear set, and an edge of the cam pushes and presses at the upper baffle and the lower baffle of the slide member, and the press plate of the slide member moves back and forth to press the foam soap valve, so as to define a stroke of a pressing operation to supply soap.

2. A countertop automatic foam soap dispenser, comprising: an automatic foam soap dispenser body, a soap liquid container and an AC adapter, characterized in that:

the soap liquid container is filled with an appropriate quantity of liquid soap, and has a circular connecting tube installed at the top of the soap liquid container, and a connecting socket disposed at the top of the soap liquid container and proximate to a side of the circular connecting tube;

the automatic foam soap dispenser body is installed and passed through the circular connecting tube by a soap transmission tube and extended to the bottom inside the soap liquid container, such that the automatic foam soap dispenser is driven to supply an appropriate quantity of foam soap when a user's hand approaches the automatic foam soap dispenser body;

the AC adapter provides a power, and the AC adapter is electrically coupled to a connecting socket through a connecting plug installed at an end of the power cord, and the connecting socket is electrically coupled to a power cable, and the power cable is electrically coupled to the automatic foam soap dispenser;

the liquid soap container is installed under the countertop of the sink, and the circular connecting tube at the top of the liquid soap container is penetrated through the countertop of the sink and coupled to the bottom of the automatic foam soap dispenser body for combining and fixing the liquid soap container and the automatic foam soap dispenser body to the countertop of the sink to assemble a whole countertop automatic foam soap dispenser structure;

wherein the press device comprises a fixed plate, a motor, a transmission gear set, two fixing members and a slide member, characterized in that:

the fixed plate has a plurality of screw holes;

the motor is installed at a lower edge of the rear of the fixed plate;

the transmission gear set includes a plurality of large and small gears engaged with one another and installed and axially coupled to an upper edge of the fixed plate, and a cam axially coupled to the transmission gear set, and the motor is rotated to synchronously rotate the cam of the transmission gear set;

the two fixing members have a concave long slot formed at the middle of an inner side of the fixing members, and two screw holes formed on an outer side of the fixing members;

the slide member includes a slender protruding block convexly extended from both sides of the slide member, a press plate convexly and vertically extended upward from a front end of the slide member, and a semicircular arc groove hole concavely formed at the middle of the press plate, and a snap slot of a nozzle at a front end of the foam soap valve is snapped into the semicircular arc groove, and the slide member is substantially a frame cover having an upper baffle disposed at the bottom of a side of the frame cover, and a lower baffle disposed on the other side of the frame cover; and the slide member has a protruding block disposed separately on both sides of the slide member and installed in a long groove of each of the two fixing members, a plurality of screws installed into screw holes on external sides of the two fixing members respectively and screwed into screw holes of the fixed plate to cover the slide member onto a cam of the transmission gear set, so as to assemble a whole press device structure, and the motor is rotated to synchronously rotate the cam of the transmission gear set, and an edge of the cam pushes and presses at the upper baffle and the lower baffle of the slide member, and the press plate of the slide member moves back and forth to press the foam soap valve, so as to define a stroke of a pressing operation to supply soap.

3. A countertop automatic foam soap dispenser, comprising: an automatic foam soap dispenser body, a soap liquid container and a power source, characterized in that:

the soap liquid container is filled with an appropriate quantity of liquid soap, and has a circular connecting tube installed at the top of the soap liquid container, and a connecting socket disposed at the top of the soap liquid container and proximate to a side of the circular connecting tube;

the automatic foam soap dispenser body is installed and passed through the circular connecting tube by a soap transmission tube and extended to the bottom inside the soap liquid container, such that the automatic foam soap dispenser is driven to supply an appropriate quantity of foam soap when a user's hand approaches the automatic foam soap dispenser body;

the power source provides a electric power, and a connecting plug installed at an end of the power cord is electrically coupled to a connecting socket, and the connecting socket is electrically coupled to a power cable, and the power cable is electrically coupled to the automatic foam soap dispenser;

the liquid soap container is installed under the countertop of the sink, and the circular connecting tube at the top of the liquid soap container is penetrated through the countertop of the sink and coupled to the bottom of the automatic foam soap dispenser body for combining and fixing the liquid soap container and the automatic foam soap dispenser body to the countertop of the sink to assemble a whole countertop automatic foam soap dispenser structure;

wherein the press device comprises a fixed plate, a motor, a transmission gear set, two fixing members and a slide member, characterized in that:

the fixed plate has a plurality of screw holes;

the motor is installed at a lower edge of the rear of the fixed plate;

the transmission gear set includes a plurality of large and small gears engaged with one another and installed and axially coupled to an upper edge of the fixed plate, and a cam axially coupled to the transmission gear set, and the motor is rotated to synchronously rotate the cam of the transmission gear set;

the two fixing members have a concave long slot formed at the middle of an inner side of the fixing members, and two screw holes formed on an outer side of the fixing members;

the slide member includes a slender protruding block convexly extended from both sides of the slide member, a press plate convexly and vertically extended upward from a front end of the slide member, and a semicircular arc groove hole concavely formed at the middle of the press plate, and a snap slot of a nozzle at a front end of the foam soap valve is snapped into the semicircular arc groove, and the slide member is substantially a frame cover having an upper baffle disposed at the bottom of a side of the frame cover, and a lower baffle disposed on the other side of the frame cover; and the slide member has a protruding block disposed separately on both sides of the slide member and installed in a long groove of each of the two fixing members, a plurality of screws installed into screw holes on external sides of the two fixing members respectively and screwed into screw holes of the fixed plate to cover the slide member onto a cam of the transmission gear set, so as to assemble a whole press device structure, and the motor is rotated to synchronously rotate the cam of the transmission gear set, and an edge of the cam pushes and presses at the upper baffle and the lower baffle of the slide member, and the press plate of the slide member moves back and forth to press the foam soap valve, so as to define a stroke of a pressing operation to supply soap.

4. The countertop automatic foam soap dispenser of claim 3, wherein said power source is a battery compartment that provides a direct-current power.

5. The countertop automatic foam soap dispenser of claim 3, wherein said power source is an AC adapter, said AC adapter is electrically coupled to a connecting socket through said connecting plug.

* * * * *